US007487745B2

(12) United States Patent
Rettig et al.

(10) Patent No.: US 7,487,745 B2
(45) Date of Patent: Feb. 10, 2009

(54) BOILER TUBE POSITION RETAINER ASSEMBLY

(76) Inventors: Mark Rettig, 148 Soth Cove Ct., Bessemer, AL (US) 35020; Samuel Clifton, 233 Helen St., Westlake, LA (US) 70669; Michael Sullivan, 313 Conde Ave., Dauphin Island, AL (US) 36528

( * ) Notice: Subject to any disclaimer, the term of this patent is extended or adjusted under 35 U.S.C. 154(b) by 0 days.

(21) Appl. No.: 11/411,876

(22) Filed: Apr. 27, 2006

(65) Prior Publication Data

US 2006/0243223 A1 Nov. 2, 2006

Related U.S. Application Data

(60) Provisional application No. 60/594,691, filed on Apr. 28, 2005.

(51) Int. Cl.
*F22B 37/24* (2006.01)

(52) U.S. Cl. ..... 122/510; 122/511

(58) Field of Classification Search ..... 122/511, 122/510, 4 R; 165/910, 162; 49/158–161; 16/231, 234, 387, 356, 254, 270, 86.1, 86.2, 16/260–262; 403/49, 389, 364; 376/462
See application file for complete search history.

(56) References Cited

U.S. PATENT DOCUMENTS

| | | | | | |
|---|---|---|---|---|---|
| 2,310,801 | A | * | 2/1943 | Mayo et al. | 122/510 |
| 2,345,257 | A | * | 3/1944 | Hensel et al. | 122/510 |
| 2,469,487 | A | * | 5/1949 | Woodard et al. | 122/510 |
| 2,923,279 | A | * | 2/1960 | Schmidli | 122/510 |
| 4,685,426 | A | * | 8/1987 | Kidaloski et al. | 122/510 |
| 5,042,452 | A | * | 8/1991 | Dubreuil et al. | 122/510 |
| 5,136,985 | A | | 8/1992 | Krowech | |
| 5,855,699 | A | * | 1/1999 | Oyama et al. | 148/519 |
| 5,943,985 | A | * | 8/1999 | Hartman | 122/511 |
| 6,244,330 | B1 | | 6/2001 | Eisinger et al. | |
| 6,273,030 | B1 | | 8/2001 | Harth, III | |

* cited by examiner

*Primary Examiner*—Gregory A Wilson
(74) *Attorney, Agent, or Firm*—John J. Yim

(57) ABSTRACT

The tube assembly device of the present invention maintains spacing for proper heat transfer and avoids tubing wall removal should weld failure occur, thereby decreasing leakage of boiler tubes, shut down time and unscheduled down time for inspections and repairs. Productivity of the boilers is increased and maintenance costs are decreased. In the event of excess stress on the positioning assembly, the retainer assembly of the present invention allows for failure points to occur on the boiler tube position retainer assemblies rather than on the boiler tubes themselves.

5 Claims, 4 Drawing Sheets

BOILER TUBE POSITION RETAINER ASSEMBLY

CROSS REFERENCE TO RELATED APPLICATION

This patent application is the utility application of the previously filed U.S. Provisional Application No. 60/594,691, entitled "Boiler Tube Position Retainer Assembly" filed on Apr. 28, 2005. The Provisional Application is incorporated herein by reference.

BACKGROUND OF INVENTION

The present invention concerns a boiler tube position retainer assembly for stabilizing and supporting boiler tubes in boilers. The present invention more particularly concerns boiler tube clips for use in large industrial boilers. Primary or secondary furnace superheaters and reheaters function as important industrial power sources throughout the world. Power boilers, which may be one hundred feet in width or more with boiler tubes of over forty feet in length, are used as industrial power generators in various applications. For example, industrial power boilers may be used as steam generators in paper mills or power plants.

Similar to a smoke stack, superheated gases enter through one end of a furnace and exit through the other end. Metal boiler tubes are positioned across the flow of heated gas to maximize the heat transfer to the metal tubes. Boiler tubes are spaced apart to allow gas to flow around the metal boiler tubes. Although these metal boiler tubes are positioned to maximize heat transfer, debris may get caught between the boiler tubes if they are spaced too close together. If boiler tubes are positioned too far apart, heat transfer may not be maximized.

When water is pumped through the boiler tubes, the boiler becomes a powerful steam generator. Water entering into the boiler tube at one end may quickly heat to become superheated steam of over nine hundred degrees Fahrenheit.

NEED IN THE ART

Once the boiler tubes are positioned as desired, they are stabilized and kept in place by tube clips or boiler tube assemblies. Such assemblies also structurally support the boiler tubes during operation of the heaters. Previously, boiler tubes clips and assemblies were often welded directly onto the boiler tubes. One piece of the clip may be welded to the boiler tube directly, while another piece of the clip may be welded directly to the adjacent tube.

As seen in an example of a prior art assembly in FIG. 1, boiler tubes 10 and 11 are positioned and held together by clips 12 and 14. Clip 12 is welded directly to boiler tube 10 at their contact surface, such as at contact point 16. The boiler tube 10 will be welded to clip 12 by a vertical grooved weld, a horizontal weld at the top, and a horizontal overhead weld on the other side. Each welding must be accomplished by a certified welder with adequate experience and knowledge. Also such welds often weld through the boiler tube 10. Similarly, clip 14 may be welded directly onto the boiler tube 11 at their contact surface, such as at contact point 18. Such welds must also be done by authorized certified welders to include a bottom, horizontal overhead weld, a vertical up weld, and again a horizontal overhead weld.

When the two pieces of this assembly are properly positioned, there is very little tolerance for expansion and contraction of the boiler tubes, thereby placing stress on the tubes at the weld connection. When the stress is too great, the boiler tubes will break, rupture or leak, causing leakage and eventual shut down of the boiler for an unscheduled repair. The clip is generally stronger than the boiler tubing, and therefore tube failure occurs before clip failure in most cases.

Another example of boiler tube assemblies or clips 22 and 24 are seen in FIG. 2. As in the example in FIG. 1, such clips 22 and 24 are welded directly through the boiler tubes 20 and 21 at contact points such as 28 and 26. Each weld must again be done by a certified welder, using multiple weld steps. Again, problems similar to the example in FIG. 1 are also present. There is very little tolerance for expansion and contraction of the boiler tubes 20 and 21, putting the stress on the welds, again resulting in tube failure prior to clip failure.

In the prior art, such welds penetrate through the boiler tubes and introduce weak points as the boiler tubes and clips expand and contract during normal operation of the furnace. Superheating causes stress and contributes to instability. Because these pressure part attachments do not adequately allow for expansion and contraction, or for allowances and movement caused by vibrations due to movement of gases and soot, such attachments often fail. In addition, because such clip assemblies are often made of cast iron material, which are stronger than the boiler tubes, failure often occurs at the weld points of the boiler tubes. Failure at such points will lead to boiler tubes rupturing or leaking.

When the boiler tubes fail, steam leaks cause the stoppage of the power boilers. Loss of productivity ensues until the entire tube assembly is examined and the leakage is identified and corrected. Each weld connection must often be examined by licensed professionals and corrected to industry standards. Specialized inspectors and welders are needed for boiler code inspection. Such failures cost boiler operators loss of productivity and increased expenses.

DESCRIPTION OF INVENTION

The present invention concerns a saddle clip styled, boiler tube position retainer assembly for securing boiler tubes in power boilers. The present invention supports and stabilizes the boiler tubes while allowing for slight vertical and horizontal movements. The present invention also concerns a method for positioning and stabilizing boiler tubes in power boilers, while allowing for some vertical and horizontal movement during expansion and contraction without damage to tube sheet or boiler tubes.

The tube assembly device of the present invention maintains spacing for proper heat transfer and avoids tubing wall removal should weld failure occur, thereby decreasing leakage of boiler tubes, shut down time and unscheduled down time for inspections and repairs. Productivity of the boilers is increased and maintenance costs are decreased. In the event of excess stress on the positioning assembly, the boiler tube position retainer assembly of the present invention allows for failure points to occur on the boiler tube position retainer assemblies rather than on the boiler tubes themselves.

Furthermore, fewer procedures are required to assemble the boiler tube position retainer assembly of the present invention, i.e., two vertical welds per attached saddle components, male and female. If failure is imminent, the clip is designed to fail prior to damaging the pressurized tubes. Using the present invention, less welding steps and procedures are involved and results in a simpler device. Overall, the assembly of the present invention is more cost effective, and less boiler tube failure results in fewer shut downs and decreased cost of repairs.

Figure 1:
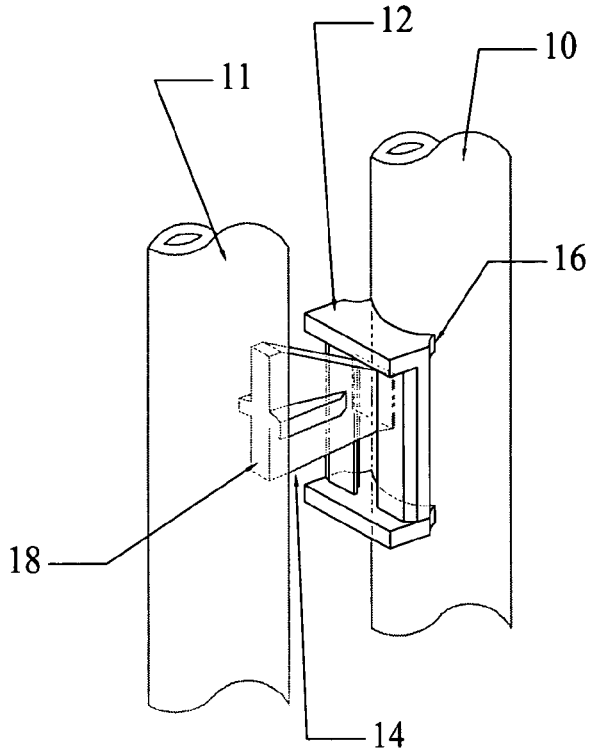
FIG. 1 (PRIOR ART)
FIG. 1 illustrates a prior art boiler tube clip assembly.
Figure 2:
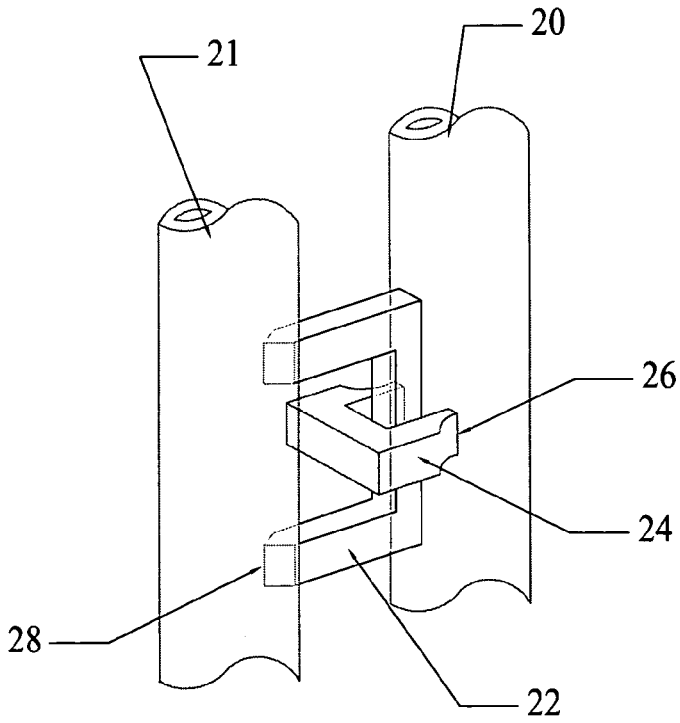
FIG. 2 (PRIOR ART)
FIG. 2 illustrates another prior art boiler tube assembly.
Figure 3:
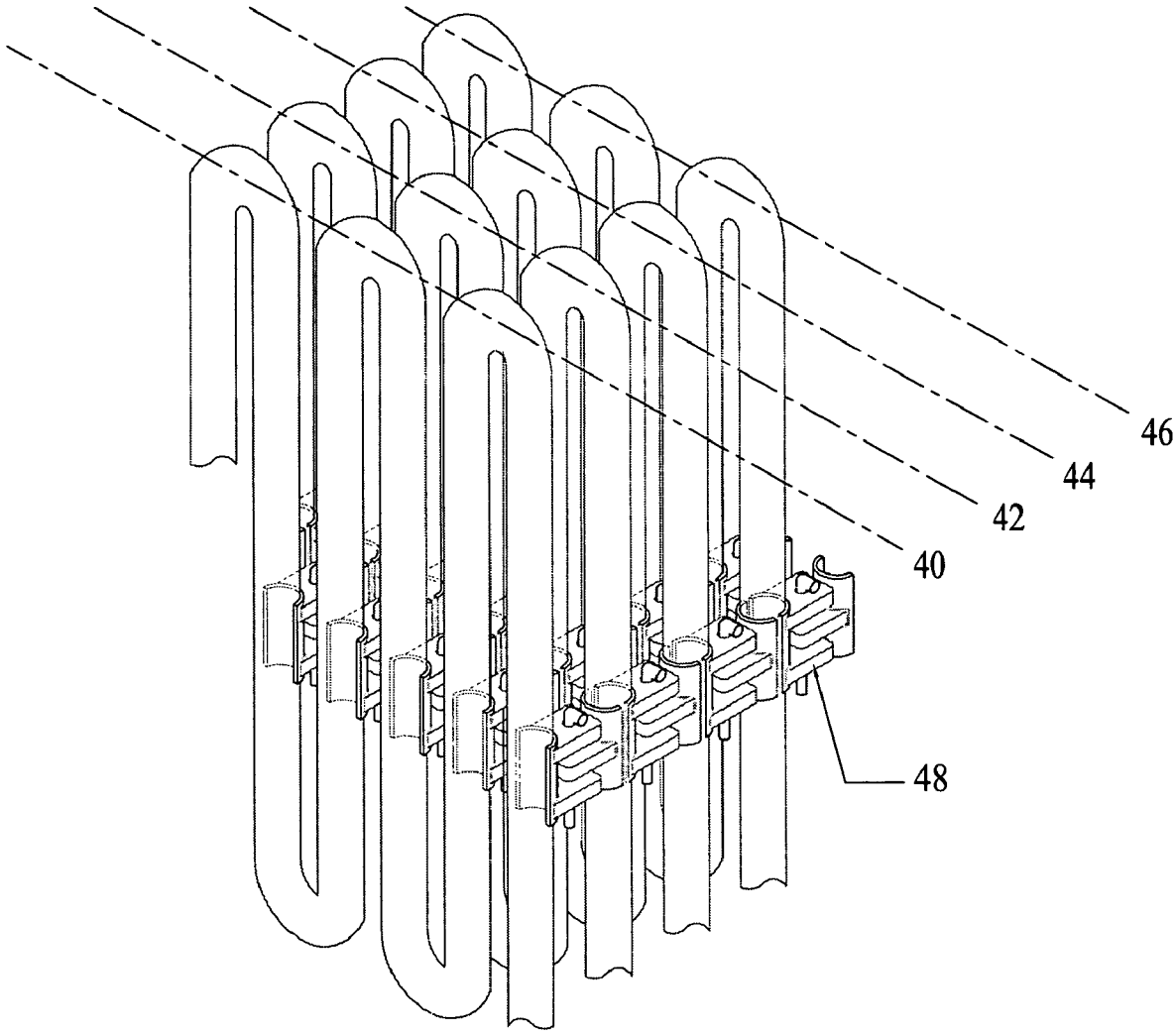
FIG. 3 shows the boiler tubes arranged in tube sheets and secured by boiler tube position retainer assemblies of the present invention.

FIG. 3 shows tube sheets 40, 42, 44 and 46 placed along parallel planes, secured by the boiler tube position retainer assemblies 48 of the present invention. Tube sheets 40, 42, 44, and 46 are spaced and supported by multiple units of the tube position retainer assembly 48.

Figure 4:
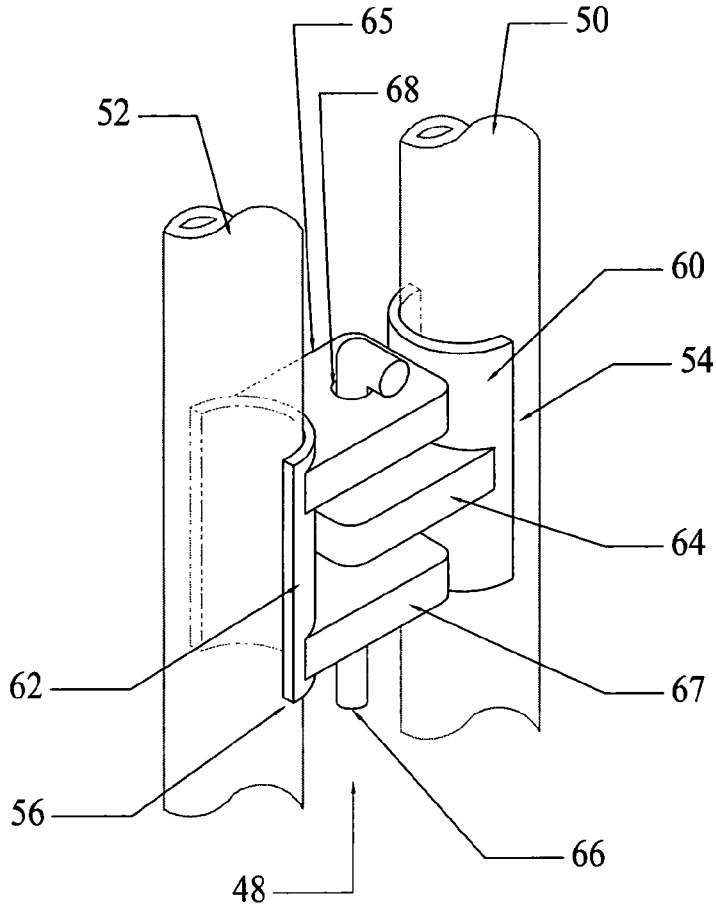
FIG. 4 shows a close-up view of the boiler tube position retainer of the present invention saddling adjacent boiler tubes.
Figure 6:
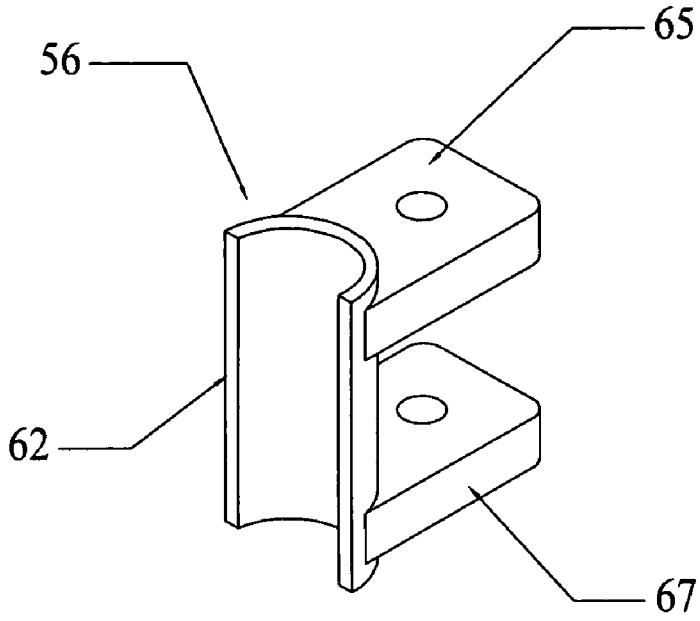
FIG. 6 is an exploded view of the female tube attachment pad.
Figure 7:
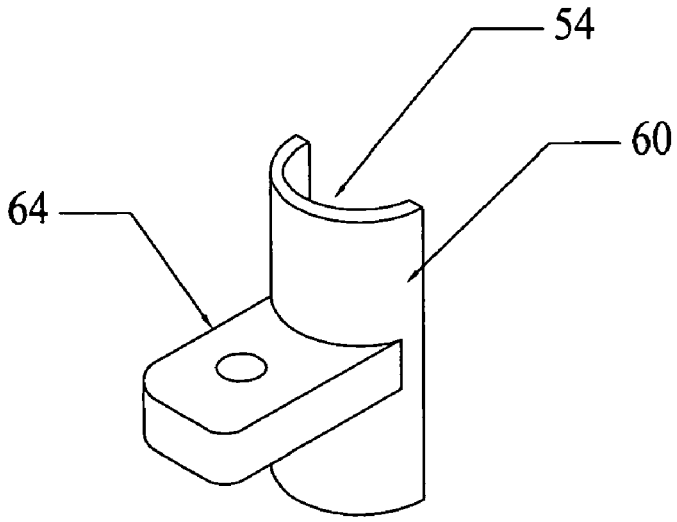
FIG. 7 is an exploded view of the male tube attachment pad.

FIG. 4 illustrates an embodiment of a single unit of the boiler tube position retainer assembly 48 of the present invention. Boiler tubes 50 and 52 are adjacent boiler tubes from different tube sheets of FIG. 3 The boiler tube position retainer assembly 48 comprises saddle clips or tube attachment pads 54 and 56 and a retainer pin 66. Boiler tube pad 54 is a male boiler tube pad 54 comprising a tab ear portion 64 and a saddle clip portion 60. Boiler tube pad 56 is a boiler tube attachment pad 56 having two tab ear portions 65 and 67 and a saddle clip portion 62. The tab ear portion 64 of the male boiler tube attachment pad 54 is positioned between the two tab ear portions 65 and 67 of the female boiler tube attachment pad 56. The tube attachment pads 54 and 56 are preferably made using ASME code approved material. FIG. 6 illustrates the female tube attachment pad 56, and FIG. 7 illustrates the male tube attachment pad 54.

The tube attachment pads 54 and 56 are saddled to the boiler tubes 50 and 52. They are attached by welding along the contact surface of the saddle clip portions 60 and 62 of the tube attachment pads 54 and 56 and the boiler tubes 50 and 52. Such welds are preferably vertical fillet welds, instead of full penetrations welds of the prior art.

Also, the saddle clip portions 60 and 62 have thinner walls than the boiler tubes 50 and 52. Thus, in the event of stress or breakage, failure occurs preferably by tearing of one or more of the pad ear portions 64, 65 or 67 from the saddle clip portions 60 and 62 without damage to the boiler tubes 50 and 52. Thus, the present invention allows for a much more convenient correction mechanism that saves cost and time and increases productivity. Unlike prior art assemblies that require welds that penetrate through the boiler tubes or have clip assemblies that are stronger than the boiler tubes themselves, the current invention allows for failure to occur at the clip assembly itself, which can easily be replaced instead of repairing the boiler tubes themselves.

Preferably, the tube attachment pads are each formed as a one-piece item comprising a pad ear portion or pad ear portions and a saddle clip portion. Thus, tube attachment pad 54 comprises saddle clip portion 60 and pad ear portion 64, and tube attachment pad 56 comprises saddle clip portion 62 and pad ear portions 65 and 67.

Each pad ear contains an alignment hole. For example, pad ear 65 has an alignment hole 68, which is drilled perpendicular to the plane of the pad ear portion 65 to form an alignment hole 68. Alignment holes for pad ears 64 and 67 are not shown in FIG.4. The alignment holes of the pad ears 64, 65 and 67 are then aligned to accept the connector or retained pin 66.

The retaining pin 66 need not necessarily be made of code material. The retaining pin 66 maintains the spacing between the boiler tubes 50 and 52 by keeping tube attachments pads 54 and 56 at relatively fixed distances. Because the retaining pin 66 is not welded, the boiler tune position retainer assembly 48 of the present invention allows for some vertical and horizontal movement of the boiler tubes 50 and 52. Such movement may occur during start up and operation of these super boilers and allows for expansion and contraction during high temperature fluctuations.

Figure 5:
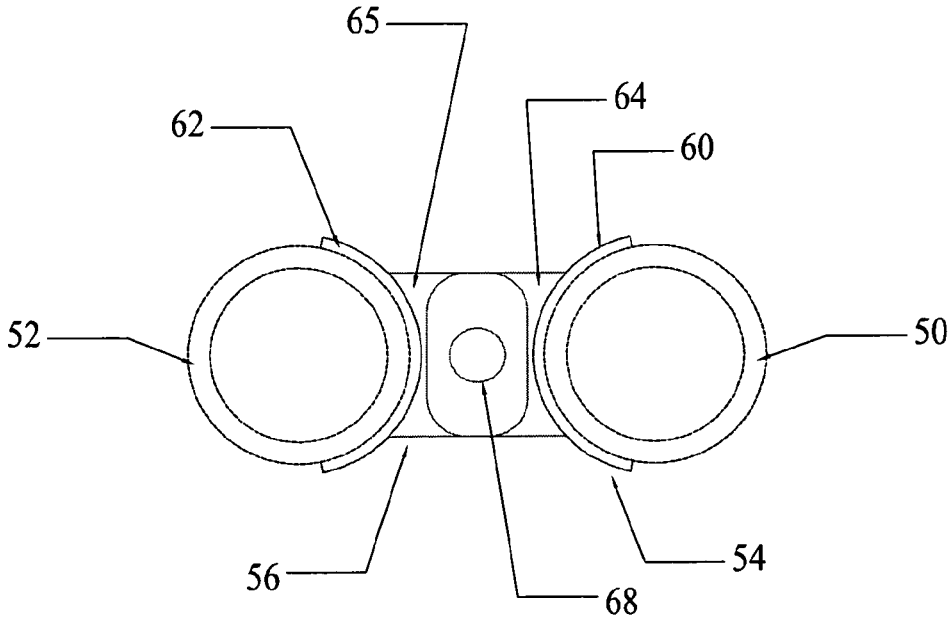
FIG. 5 is a plan view of the boiler tube position retainer assembly of the present invention saddling adjacent boiler tubes.

FIG. 5 shows a plan view of a single unit of the boiler tube position retainer assembly of the present invention. As seen in FIG. 3, boiler tubes 50 and 52 are adjacent boiler tubes from different tube sheets. The male tube attachment pad 54 comprises the saddle clip portion 60 and tab ear portion 64, and the female tube attachment pad 56 comprises the saddle clip portion 62 and tan ear portions 65 and 67 (not shown). The alignment hole 68 of the tab ear 65 aligns with the alignment holes of tab ear portions 64 and 64 to receive the retaining pin (not shown). As seen in FIG. 5, the ends of the tab ear portions 65 and 67 are preferably not in contact with the opposing saddle clip portions 60 and 62. This allowance allows for some movement of the boiler tubes 50 and 52 during operation. Furthermore, as seen in FIG. 5, the wall of the boiler tubes 50 and 52 are preferably thicker than the walls of the saddle clip portions 60 and 62.

Examining FIG. 4 again, spacing distances between boiler tubes 50 and 52 and the diameters of boiler tubes 50 and 52 will vary, depending on boiler size and configuration, engineering requirement, and site conditions, as known in the art. Sizing and dimensional characteristics may be sized to accommodate various boiler tube spacing design parameters as they may vary from one boiler to another. Such boilers are often custom manufactured, depending on custom needs.

The present invention is further advantageous in that special quantities and differing dimensional characteristics may be easily fabricated. For example, when large quantities are required, the boiler tube position retainer assemblies of the present invention may be may be easily manufactured using code approved castings.

We claim:

1. A steam generating boiler comprising:

a combustion chamber comprising two or more boiler tubes, wherein each boiler tube comprises an inner diameter and an outer diameter, wherein difference between the outer diameter and the inner diameter is wall thickness of the boiler tubes; and one or more boiler tube position retainer assemblies, wherein each boiler tube position retainer assembly is positioned between two boiler tubes, a first boiler tube and a second boiler tube, wherein each boiler tube position retainer assembly further comprises:

a male boiler tube pad comprising a male tab ear portion and a male saddle clip portion, wherein the male saddle clip portion has a tube shape configuration to saddle the first boiler tube, wherein wall thickness of the male saddle clip portion is less than the wall thickness of the first boiler tube to allow for failure to occur on the male boiler tube pad before failure of the first boiler tube, and wherein the male tab ear portion has an alignment hole;

a female boiler tube pad comprising two female tab ear portions and a female saddle clip portion, wherein the female saddle clip portion has a tube shape configuration to saddle the second boiler tube, wherein wall thickness of the female saddle clip portion is less than the wall thickness of the second boiler tube to allow for failure to occur on the female boiler tube pad before failure of the second boiler tube, and wherein each female tab ear portion has an alignment hole;

a retainer pin for insertion through the alignment holes following alignment of the alignment holes by positioning the male tab ear portion between the two female tab ear portions;

wherein the diameter of the retainer pin is less than the diameter of the alignment holes to allow movement of the male and the female boiler tube pads around the axis of the retainer pin, and wherein the retainer pin hangs to allow movement of the male and the female boiler tube pads along the length of the retainer pin; and wherein the two female tab ear portions are attached to the female saddle clip portion to allow for space between the female tab ear portions and the male tab ear portion after positioning of the male tab ear portion between the female tab ear portions, wherein the male and the female tab ear portions are not in contact to allow for movement of the male and the female boiler tube pads long the length of the retainer pin.

2. The steam generating boiler according to claim 1, wherein the male saddle clip portion is welded to the first boiler tube using a fillet weld to allow for failure to occur on the male saddle clip portion before failure of the first boiler tube.

3. The steam generating boiler according to claim 1, wherein the female saddle clip portion is welded to the second boiler tube using a fillet weld to allow for failure to occur on the female saddle clip portion before failure of the second boiler tube.

4. The steam generating boiler according to claim 1, wherein distal end of the male tab ear portion is not in contact with the female saddle clip upon alignment of the alignment holes and insertion of the retainer pin.

5. The steam generating boiler according to claim 1, wherein distal ends of the female tab ear portions are not in contact with the male saddle clip upon alignment of the alignment holes and insertion of the retainer pin.

* * * * *